US007747032B2

(12) United States Patent
Zei et al.

(10) Patent No.: US 7,747,032 B2
(45) Date of Patent: Jun. 29, 2010

(54) CONJOINED RECEIVER AND MICROPHONE ASSEMBLY

(75) Inventors: John Zei, Barrington, IL (US); Dennis R. Kirchhoefer, Plainfield, IL (US); Evan Llamas-Young, Algonquin, IL (US)

(73) Assignee: Knowles Electronics, LLC, Itasca, IL (US)

( * ) Notice: Subject to any disclaimer, the term of this patent is extended or adjusted under 35 U.S.C. 154(b) by 1086 days.

(21) Appl. No.: 11/382,318

(22) Filed: May 9, 2006

(65) Prior Publication Data

US 2006/0251279 A1 Nov. 9, 2006

Related U.S. Application Data

(60) Provisional application No. 60/679,170, filed on May 9, 2005.

(51) Int. Cl.
*H04R 25/00* (2006.01)
*H04R 1/02* (2006.01)

(52) U.S. Cl. ..... 381/321; 381/351; 381/182; 381/355; 381/360

(58) Field of Classification Search ..... 381/108, 381/182, 186, 312–331, 351, 357–358, 118
See application file for complete search history.

(56) References Cited

U.S. PATENT DOCUMENTS 2,634,337 A * 4/1953 Bland ..... 381/322
3,458,668 A 7/1969 Hassler
3,742,156 A 6/1973 Broersma
4,109,116 A 8/1978 Victoreen
4,329,547 A 5/1982 Imai
5,987,146 A 11/1999 Pluvinage et al.
6,021,207 A 2/2000 Puthuff et al.
6,130,951 A * 10/2000 Nakamura et al. ..... 381/337
6,181,801 B1 1/2001 Puthuff et al.
6,275,596 B1 8/2001 Fretz et al.

(Continued)

FOREIGN PATENT DOCUMENTS

DE 24 06 219 8/1975

(Continued)

OTHER PUBLICATIONS

International Search Report for Application No. PCT/US06/017691 dated Sep. 29, 2006.

*Primary Examiner*—Curtis Kuntz
*Assistant Examiner*—Ryan C Robinson
(74) *Attorney, Agent, or Firm*—Fitch, Even, Tabin & Flannery

(57) ABSTRACT

A transducer assembly may include a first transducer having a first front volume, a first back volume and a first port acoustically coupled to the first front volume; and a second transducer having a second front volume, a second back volume and second port acoustically coupled to the second front volume. The first front volume and the second front volume are acoustically coupled to increase the effective back volume of both the first transducer and the second transducer. An optional signal processing circuit may be used to control the output of the first transducer based upon a signal received from the second transducer.

10 Claims, 5 Drawing Sheets

U.S. PATENT DOCUMENTS

| | | | | |
|---|---|---|---|---|
| 6,445,799 | B1 | 9/2002 | Taenzer et al. | |
| 6,931,140 | B2 * | 8/2005 | Van Halteren et al. | 381/182 |
| 7,162,050 | B2 * | 1/2007 | Furuya et al. | 381/351 |
| 2003/0048920 | A1 | 3/2003 | Van Halteren et al. | |
| 2003/0190053 | A1 | 10/2003 | van Halteren | |
| 2008/0063223 | A1 * | 3/2008 | van Halteren et al. | 381/182 |

FOREIGN PATENT DOCUMENTS

| | | |
|---|---|---|
| DE | 25 12 343 | 10/1976 |
| GB | 2 018 089 | 10/1979 |

* cited by examiner

CONJOINED RECEIVER AND MICROPHONE ASSEMBLY

CROSS-REFERENCE TO RELATED APPLICATION

This patent claims benefit under 35 U.S.C. §119(e) to U.S. Provisional application Ser. No. 60/679,170, filed May 9, 2005 and entitled Conjoined Receiver and Microphone Assembly, the disclosure of which is hereby expressly incorporated herein for all purposes.

TECHNICAL FIELD

This patent generally relates to miniature transducers used in listening devices and portable communication devices, and more particularly, to a conjoined receiver and microphone.

BACKGROUND

A common problem with listening devices and portable communication devices is to avoid exceeding the discomfort threshold in the sound signal and to maintain a constant sound pressure level (SPL) to the listener. In order to simplify the operation of the devices, SPL can be maintained by signal amplitude regulation with a feedback structure. In such an arrangement, the amplifier input signal is fed to a level detector. The level detector output value is delivered to a control loop providing attenuation of the amplifier output signal at increasing input signal strength. However, such compensation is not capable of satisfactorily eliminating the excessive SPL to prevent potential long term damage to hearing characteristics of a person. Further, to improve the receiver efficiency, more power will be drawn from the power source, i.e. battery, to increase output. However, draining the energy from the battery may cause power supply voltage fluctuating and reduced battery life.

BRIEF DESCRIPTION OF THE DRAWINGS

For a more complete understanding of the disclosure, reference should be made to the following detailed description and accompanying drawings wherein.

DETAILED DESCRIPTION

Figure 1:
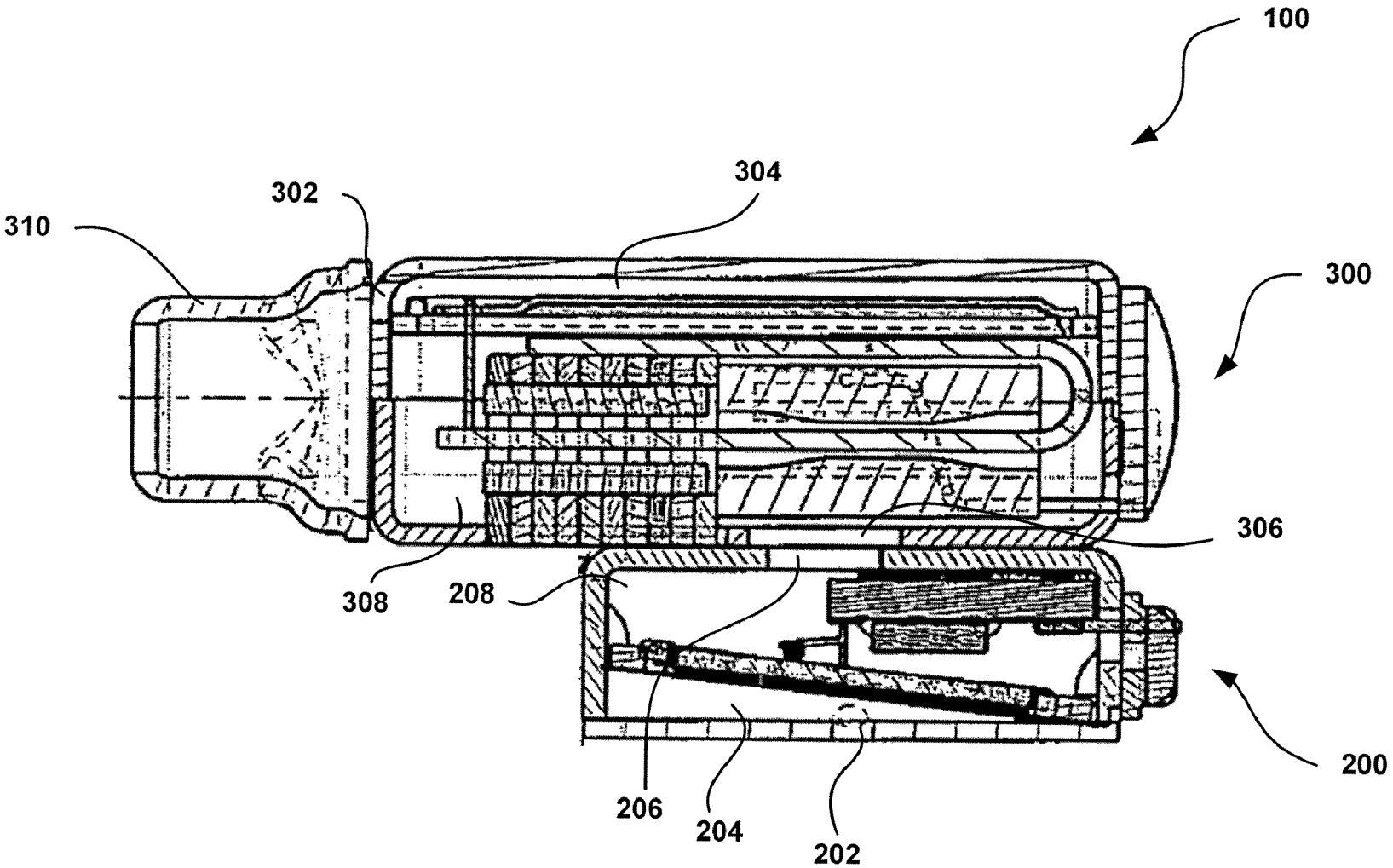
FIG. 1 is cross-sectional view of a conjoined receiver and microphone assembly.

While the present disclosure is susceptible to various modifications and alternative forms, certain embodiments are shown by way of example in the drawings and these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Unless a claim element is defined by reciting the word "means" and a function without the recital of any structure, it is not intended that the scope of any claim element be interpreted based on the application of 35 U.S.C. §112, sixth paragraph.

Figure 2:
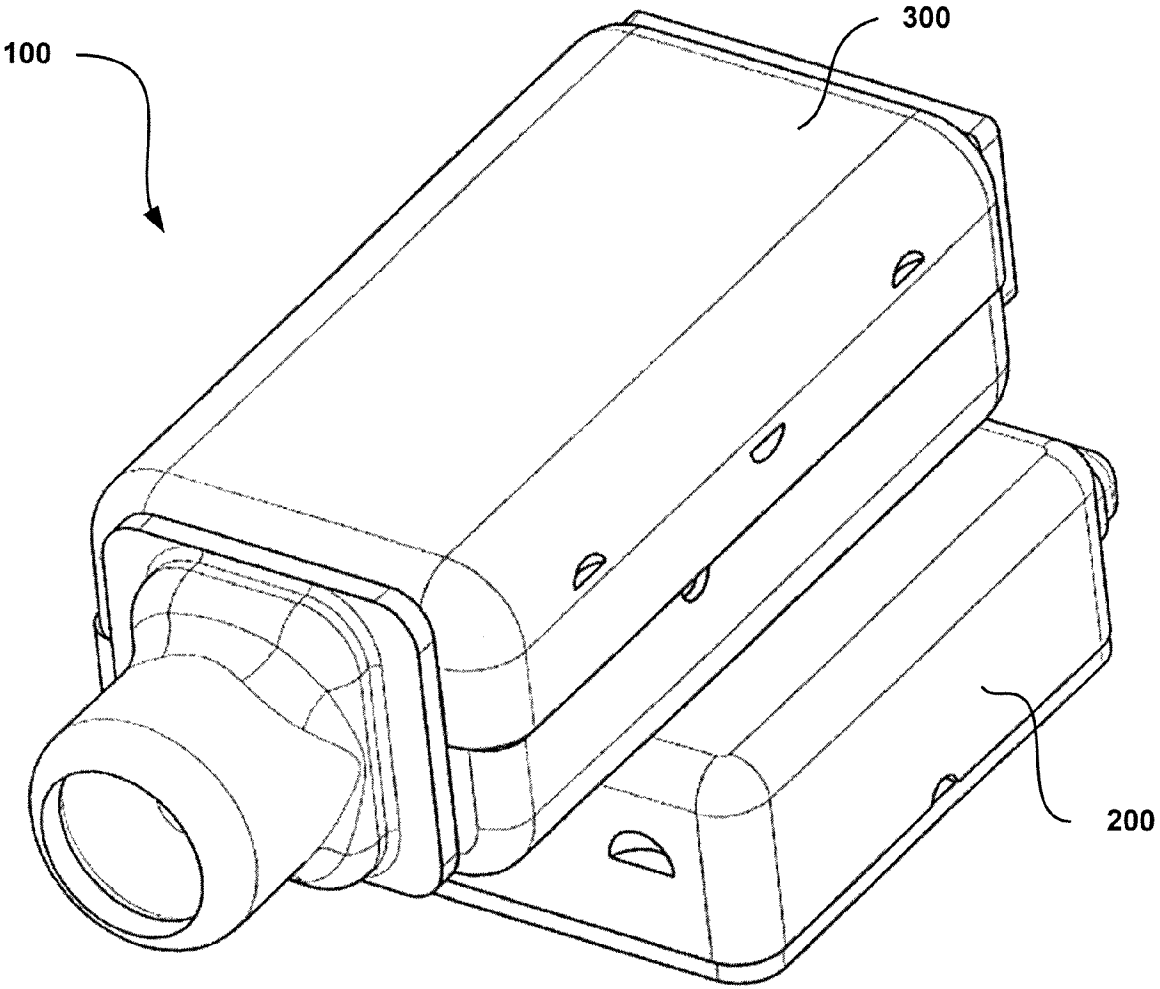
FIG. 2 is a perspective view of the conjoined received and microphone assembly of FIG. 1.

FIGS. 1-2 illustrate an exemplary embodiment of a conjoined receiver and microphone assembly 100 for use in virtually any type of device, such as cellular phones, web-enabled cellular telephones, Personal Digital Assistants (PDAs), hand-held computers, Bluetooth wireless headset, digital cameras, other types of portable computing and Internet access appliances and devices, hearings aids, in-ear monitors, electronic hearing protection devices, and the like. The assembly 100 includes a a first transducer, e.g., microphone 200 and a second transducer, e.g., receiver 300 mounted in back-to-back abutting relation to provide a shared volume. The shared volume is larger than is available in discrete devices and acts to increase the efficiency of the receiver 300 at low frequency response. In alternate embodiments, the microphone 200 and the receiver 300 can be mounted in front-to-front alignment to again provide a shared volume. Alternatively, the first and second transducer can both be receivers sharing a volume to enhance low frequency response and efficiency or can both be microphones enjoying the same benefits provided by the shared volume. A dual receiver arrangement is shown and described in commonly assigned U.S. patent application Ser. No. 60/743,805, entitled Electroacoustic Transducer System and Manufacturing Method Thereof, the disclosure of which is hereby expressly incorporated herein for all purposes.

The microphone 200 includes a front inlet port 202 communicating with a front volume 204 and a back inlet port 206 communicating with a back volume 208. The receiver 300 has a sound outlet tube 310 for transmission of an acoustic signal to a user and includes a front inlet port 302 communicating with a front volume 304 and a back inlet port 306 communicating with a back volume 308. The back inlet ports 206 of the microphone 200 and the back inlet port 306 of the receiver 300 are aligned and joined such that the back volume 208 of the microphone 200 and the back volume 308 of the receiver 300 form a single back volume, i.e., a shared volume. The increased back volume of the combined volumes 208 and 308 results in an increased efficiency of the acoustic output of the receiver 300, especially at low frequency. This configuration further eliminates a need for an additional sound tube that would otherwise be necessary to couple to the back volume 208 of the microphone 200.

Figure 3:
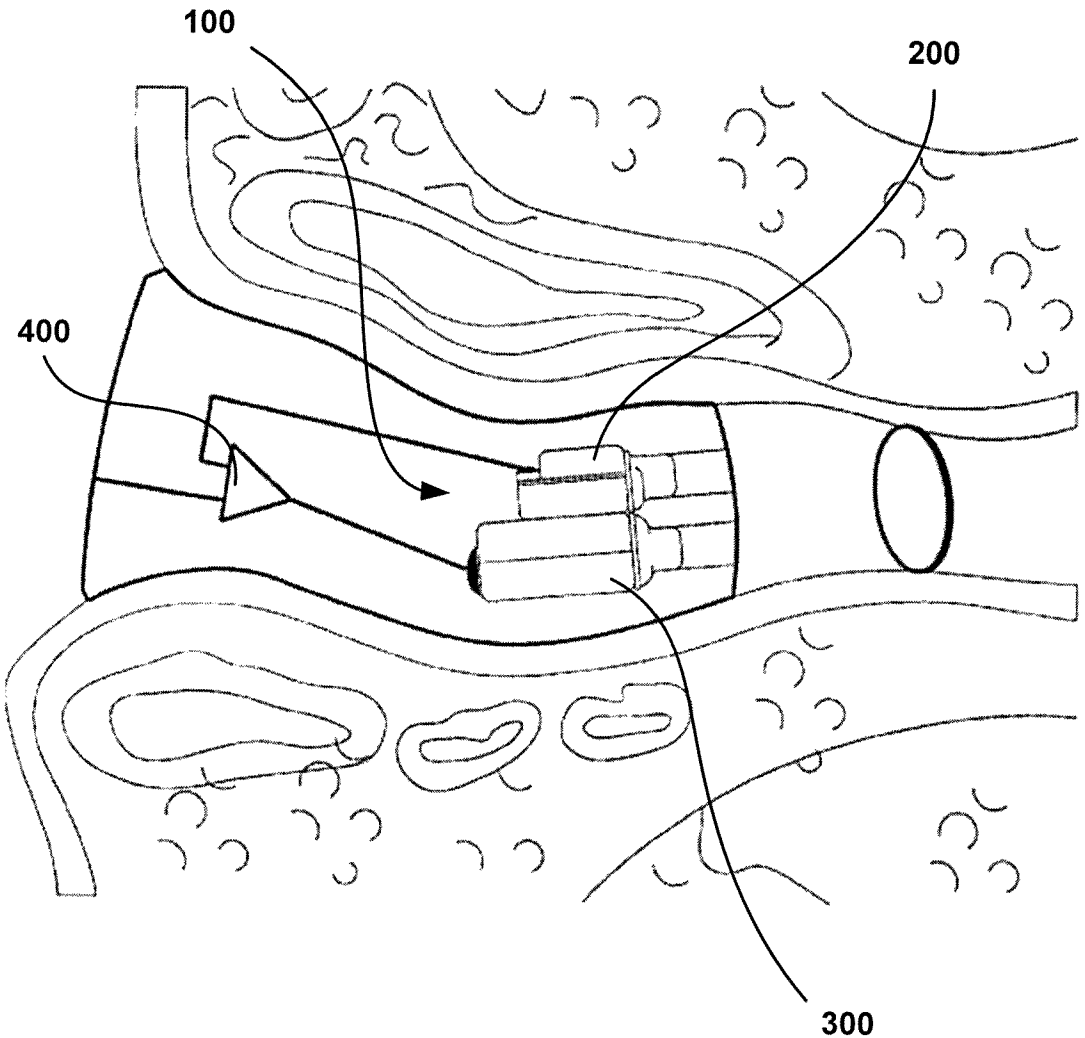
FIG. 3 is a schematic representation of a conjoined receiver and microphone assembly and a signal processing circuit.

FIG. 3 illustrates a conjoined assembly 100 adapted with a signal processing circuit 400. The conjoined assembly 100 and the signal processing circuit 400 provide for monitoring and controlling the acoustic output sound pressure level (SPL) in an ear canal. However, the conjoined assembly 100 may be used to achieve the same effects in devices not disposed directly into the ear canal. A sound signal within the ear canal entering the microphone 200 is converted to an electrical signal before transmission to the receiver 300. The control signal processing circuit 400 connected between the microphone 200 and the receiver 300 operates to generate a control signal responsive to the microphone 200 output signal. The receiver 300 is responsive to the microphone 200 output signal and the control signal such that oversensitivity of the assembly 100 in the form of excessive SPL is prevented. The receiver 300 thus receives and converts the controlled electrical signal to a sound signal for transmission to the user. The control signal processing circuit 400 may includes a control signal circuit, a converter, a SPL adjusting circuit, and/or a digital signal Processor (DSP).

Separate power sources may be provide for each of the conjoined assembly 100 and the signal processing circuit 400, which may enhance noise isolation. Furthermore, the signal processing circuit 400 may not be disposed within the housing of the conjoined assembly 100, but instead may have a separate housing and may be communicatively linked, for example by wired or wireless connection, to the conjoined assembly 100.

Figure 4:
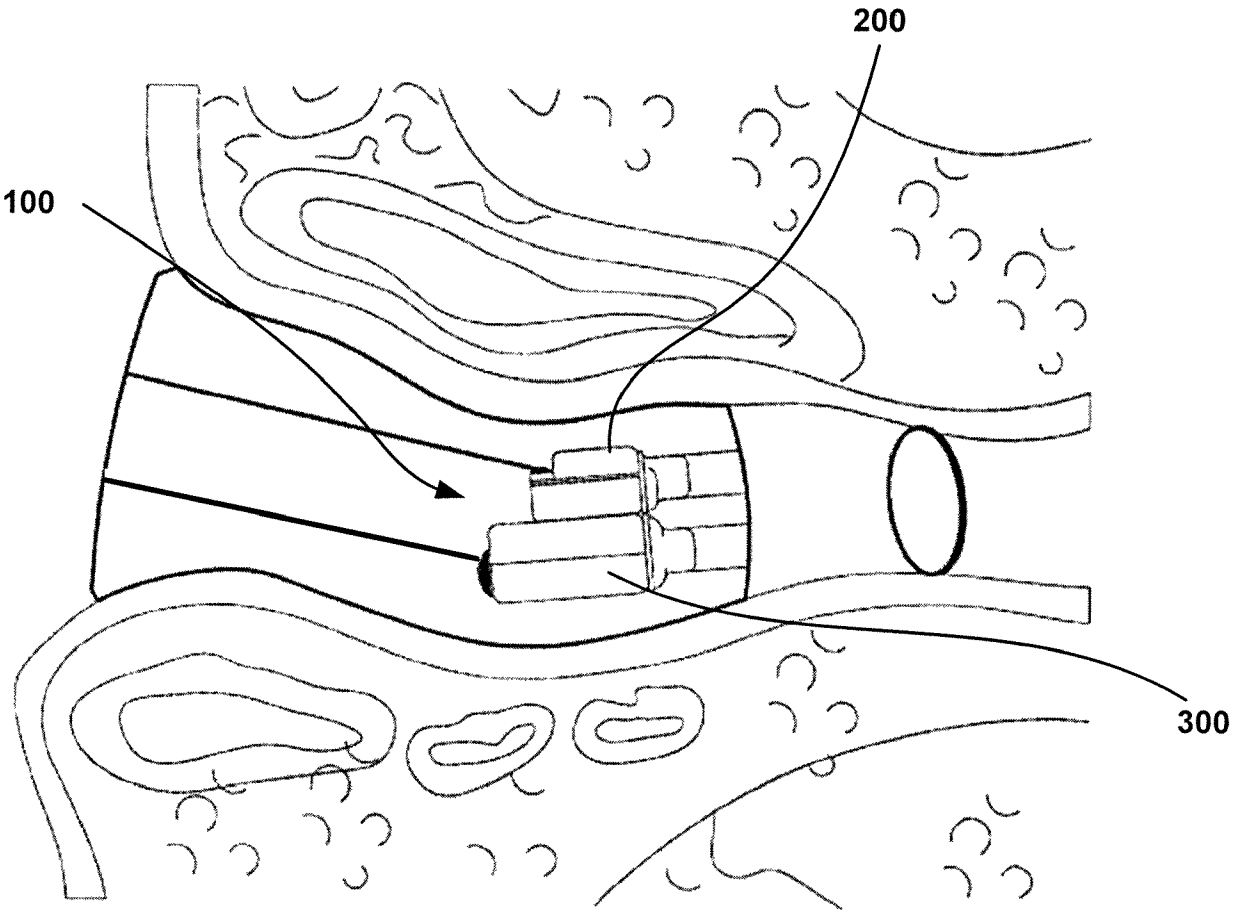
FIG. 4 is a schematic representation of a conjoined receiver and microphone assembly without a signal processing circuit.

FIG. 4 illustrates a conjoined assembly 100 without a signal processing circuit. The conjoined assembly 100 is still operable for monitoring and controlling the acoustic output sound pressure level (SPL) in an ear canal. In this embodiment, the microphone 200 is arranged to receive the sound signal generated by the receiver 300, which is used to monitor and limit the SPL of the sound signal delivered from the receiver 300 to the ear canal.

Figure 5:
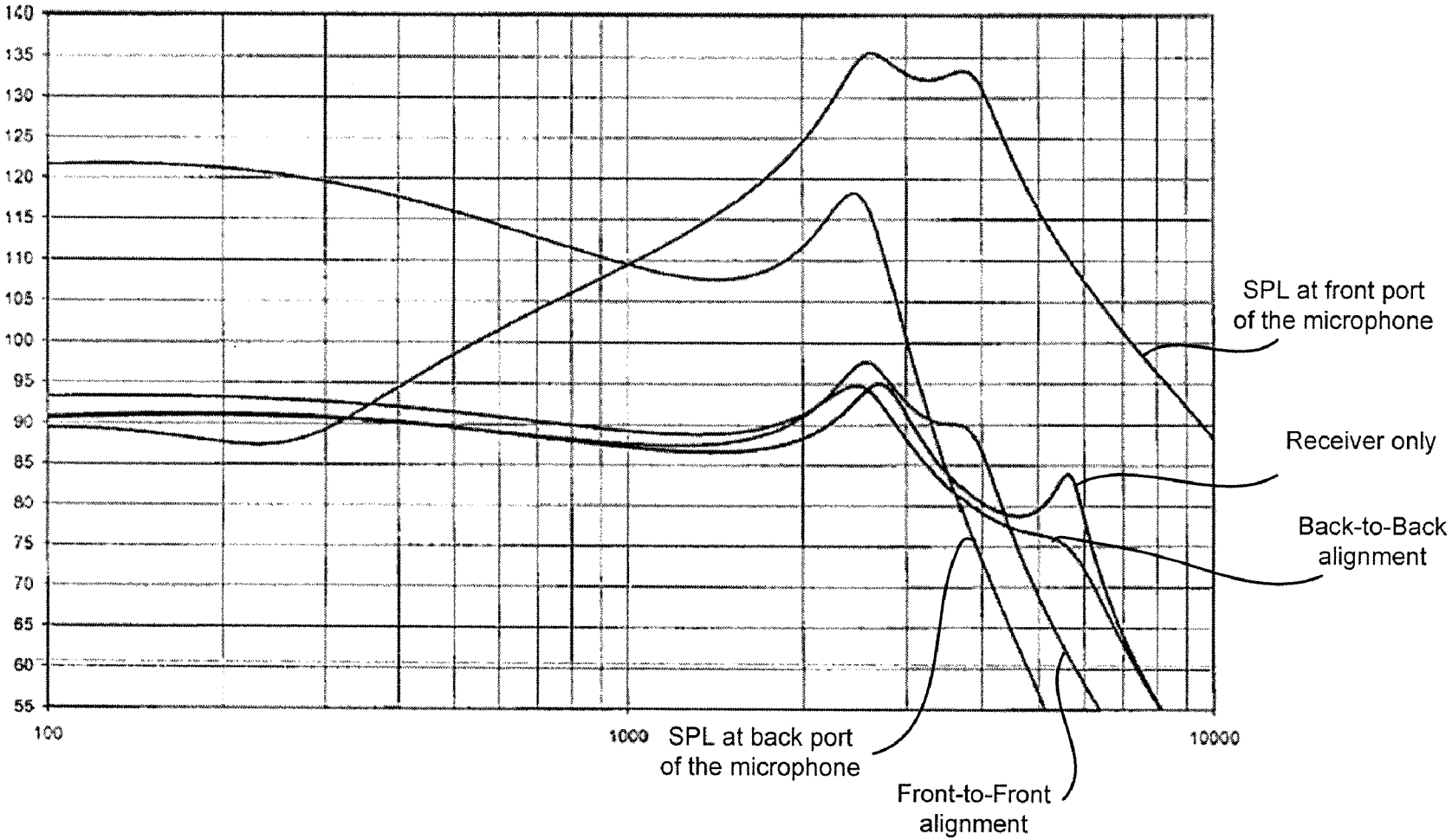
FIG. 5 is a graph indicating output sound pressure level with frequency response.

FIG. 5 illustrates a graphical representation indicating output sound pressure level with frequency response. Back volume coupling the microphone 200 to the receiver 300 preserves more bandwidth of the receiver. When back volume coupling the microphone 200 to the receiver 300, the second peak becomes more damped. In an alternate embodiment, when the microphone 200 and the receiver 300 front-to-front alignment, a higher peak level, i.e. about 3 dB is provided from the receiver 300.

All references, including publications, patent applications, and patents, cited herein are hereby incorporated by reference to the same extend as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

The invention claimed is:

1. A transducer assembly comprising:

a first housing enclosing a first transducer, the first housing defining a first front volume, a first back volume and a first port acoustically coupled to the first front volume, the first housing further defining a first aperture extending through the first housing and communicating with the first back volume; and a second housing enclosing a second transducer, the second housing being constructed so as to be separate and self-contained with respect to the first housing, the second housing defining a second front volume, a second back volume and a second port acoustically coupled to the second front volume, the second housing further defining a second aperture extending through the second housing and communicating with the second back volume;

wherein, the first housing and the second housing are coupled together such that the first aperture at least partially aligns with the second aperture to couple the first back volume and the second back volume to provide an enlarged back volume in comparison to either the first back volume or the second back volume, separately, wherein the first transducer is a receiver and the second transducer is a microphone.

2. A transducer assembly comprising:

a first housing enclosing a first transducer, the first housing defining a first front volume, a first back volume and a first port acoustically coupled to the first front volume, the first housing further defining a first aperture extending through the first housing and communicating with the first back volume; and a second housing enclosing a second transducer, the second housing being constructed so as to be separate and self-contained with respect to the first housing, the second housing defining a second front volume, a second back volume and a second port acoustically coupled to the second front volume, the second housing further defining a second aperture extending through the second housing and communicating with the second back volume;

wherein, the first housing and the second housing are coupled together such that the first aperture at least partially aligns with the second aperture to couple the first back volume and the second back volume to provide an enlarged back volume in comparison to either the first back volume or the second back volume, separately, further comprising a signal processing circuit operably coupled to each of the first transducer and the second transducer, wherein the signal processing circuit is operable on a signal from the first transducer for controlling an output of the second transducer.

3. A transducer assembly comprising:

a first housing enclosing a first transducer, the first housing defining a first front volume, a first volume and a first port acoustically coupled to the first front volume, the first housing further defining a first aperture extending through the first housing and communicating with the first back volume; and a second housing enclosing a second transducer, the second housing being constructed so as to be separate and self-contained with respect to the first housing, the second housing defining a second front volume, a second back volume and a second port acoustically coupled to the second front volume, the second housing further defining a second aperture extending through the second housing and communicating with the second back volume;

wherein, the first housing and the second housing are coupled together such that the first aperture at least partially aligns with the second aperture to couple the first back volume and the second back volume to provide an enlarged back volume in comparison to either the first back volume or the second back volume, separately, wherein an input of the first transducer being coupled to an output of the second transducer, the input of the second transducer being coupled to an output of the first transducer, wherein the output of the first transducer is controlled.

4. A device comprising:

a receiver, the receiver having a receiver housing defining a receiver front volume and a receiver back volume and an acoustic outlet port formed in the receiver housing and being coupled to the receiver front volume and a receiver electric terminal, the receiver being operable to generate an acoustic output signal from the outlet port responsive to an electrical input signal at the receiver electric terminal;

a microphone, the microphone having a microphone housing defining a microphone front volume and a microphone back volume and an acoustic inlet port formed in the pg,9 microphone housing and being coupled to the receiver front volume and a microphone electric terminal, the microphone being operable to generate an electrical signal responsive at the electric terminal responsive to an acoustic input signal received at the inlet port; and the receiver housing being formed with a receiver housing aperture extending through the receiver housing and acoustically coupled to the receiver back volume and the microphone housing being formed with a microphone housing aperture extending through the microphone housing and acoustically coupled to the microphone back volume and the receiver housing being coupled to the microphone housing so as to at least partially align the microphone aperture and the receiver aperture such that the receiver back volume is acoustically coupled to the microphone back volume via the receiver aperture and the microphone aperture to provide an enlarged conjoined back volume in comparison to either the receiver back volume or the microphone back volume, separately.

5. The device of claim 4, wherein the inlet port and the outlet port are aligned in a common direction.

6. The device of claim 4, wherein the inlet port is aligned along a first direction and the outlet port is aligned along a second direction, different than the first direction.

7. The device of claim 4, comprising a signal processing circuit operably coupled to each of the receiver electric terminal and the microphone electric terminal.

8. The device of claim 7, wherein the signal processing circuit is operable on a signal from the microphone for controlling the output of the receiver.

9. The device of claim 7, wherein the signal processing circuit is operable for controlling a sound pressure level output of the receiver.

10. The device of claim 4, an electric terminal of the receiver being coupled to the electric terminal of the microphone, the input port of the microphone being pg,10 coupled to the output port of the receiver, wherein the output of the receiver is controlled based upon the output of the microphone.

* * * * *

UNITED STATES PATENT AND TRADEMARK OFFICE

CERTIFICATE OF CORRECTION

PATENT NO. : 7,747,032 B2
APPLICATION NO. : 11/382318
DATED : June 29, 2010
INVENTOR(S) : John Zei, Dennis R. Kirchhoefer and Evan Llamas-Young It is certified that error appears in the above-identified patent and that said Letters Patent is hereby corrected as shown below:

IN THE CLAIMS:

Claim 3, Column 4, Line 57, delete “first volume” and insert --first back volume--, therefor.

Claim 4, Column 5, Line 27, after “the” delete “pg, 9”.

Claim 10, Column 6, Line 31, after “being” delete “pg, 10”.

Signed and Sealed this
Eighth Day of November, 2011

David J. Kappos

David J. Kappos
*Director of the United States Patent and Trademark Office*